US005784835A

United States Patent [19]

McArthur, Jr.

[11] Patent Number: 5,784,835

[45] Date of Patent: Jul. 28, 1998

[54] TELESCOPING SEATING SYSTEM WITH CONTINUOUS FOOT EXTENSION SUPPORT

[76] Inventor: Louis Robert McArthur, Jr., 105 Mill St., Corinth, N.Y. 12822

[21] Appl. No.: 670,676

[22] Filed: Jun. 26, 1996

[51] Int. Cl.[6] ..... E04H 3/12

[52] U.S. Cl. ..... 52/9; 52/183; 182/131; 182/223

[58] Field of Search ..... 52/8, 9, 10, 183; 182/131, 132, 223

[56] References Cited

U.S. PATENT DOCUMENTS

| | | | |
|---|---|---|---|
| 4,045,921 | 9/1977 | Molloy | 52/9 |
| 4,155,202 | 5/1979 | Hartman | 52/9 |
| 4,189,876 | 2/1980 | Crossman et al. | 52/9 |
| 4,363,197 | 12/1982 | Aurit | 52/9 |
| 4,565,036 | 1/1986 | Lyman, Jr. | 52/9 |
| 5,369,918 | 12/1994 | Ben | 52/9 |
| 5,605,025 | 2/1997 | Paddock | 52/9 |

OTHER PUBLICATIONS

Brochure titled Sheridan Gymnasium Equipment Ltd., distributed by Manufacturers Applied Renovation Systems, Inc. (M.A.R.S.) Bleacherman–Locker Doctors, 105 Mill Street, Corinth, NY 12822.

Brochure titled Interkal Telescopic Seating Systems, published by Interkal Inc., 5981 East Cork Street, P.O. 2107, Kalamazoo, Michigan 49003–2107. Brochure No. 13125/INT/BuyLine 2982.

Brochure titled Spectator Seating System, published by Kodiak Industries, Ltd., 49 Adelaide St., Winnipeg R3A OV8, Canada.

Brochure titled "From Concept To Reality With Hussey" published by Hussey Seating Company, North Berwick, Maine 03906. Brochure No. 13125/HUS/BuyLine 0099.

Brochure titled "Universal Telescopic Seating Systems 13125/INU/BuyLine 2390" distributed by Interkal Inc., 5981 East Cork Street, P.O. Box 2107, Kalamazoo, Michigan 49003–2107.

*Primary Examiner*—Christopher Kent
*Assistant Examiner*—Yvonne Horton-Richardson
*Attorney, Agent, or Firm*—Heslin & Rothenberg, P.C.; Wayne F. Reinke, Esq.

[57] ABSTRACT

A support structure for a telescoping seating system includes a wheel coupled to the underside of a foot extension, and support members coupled to the next lowest foot extension. The seat of the next lowest foot extension together with the support members provides substantially continuous support for the wheel throughout the opening and closing of the seating system.

12 Claims, 5 Drawing Sheets

TELESCOPING SEATING SYSTEM WITH CONTINUOUS FOOT EXTENSION SUPPORT

BACKGROUND OF THE INVENTION

1. Technical Field

The present invention generally relates to telescoping seating systems. More particularly, the present invention relates to support structures for foot extensions in telescoping seating systems.

2. Background Information

Currently, many telescoping seating systems suffer unnecessary deterioration, due to an insufficient support structure. For example, when such telescoping seating systems are closed, downward loads on the foot extensions, which resemble a diving board, eventually cause structural fatigue to the foot extensions, becoming a safety concern, as well as ceasing to retain the desired horizontal position during storage and opening. Such downward loads can be caused by, for example, children climbing the front of the seating system when closed or partially opened.

In the past, the problem has been proposed to be addressed by adding a wheel to the underside of the foot extensions such that when in the closed position, the wheel rests upon the seat of the next lower foot extension. However, a wide gap between the seat and support columns must be traversed by the wheel without support. Over time, the structural fatigue experienced by the foot extensions from downward loads causes the wheels to get stuck on the seats or other support members. Further, it fails to address the partially opened situation mentioned above.

Thus, a need exists for an improved telescoping seating system that provides support for the foot extensions throughout the opening and closing of the seating system.

SUMMARY OF THE INVENTION

Briefly, the present invention satisfies the need for a support structure for the foot extensions throughout the opening and closing of the telescoping seating system by providing substantially continuous support for a wheel coupled to the foot extension throughout opening and closing.

In accordance with the above, it is an object of the present invention to reduce the damage to telescoping seating systems from downward loads when in the closed position.

It is another object of the present invention to reduce the damage to telescoping seating systems from downward loads when in a partially opened position.

The present invention provides, in a first aspect, a support structure for a telescoping seating system including a plurality of seating levels, each seating level above a lowest seating level including a seat member and a foot extension member, each seat member below a highest seat member being coupled to the foot extension member of a next higher seating level. The support structure comprises one or more support members coupled to the foot extension member of a first seating level, an upper surface of each of the one or more support members being substantially coplanar with an upper surface of the seat member of a second seating level directly below the first seating level. The support structure further comprises a wheel coupled to the foot extension member of a third seating level directly above the first seating level, wherein the upper surface of the seat member of the second seating level and the upper surface of each of the one or more support members together substantially continuously support the wheel between a closed position and an opened position of the telescoping seating system.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
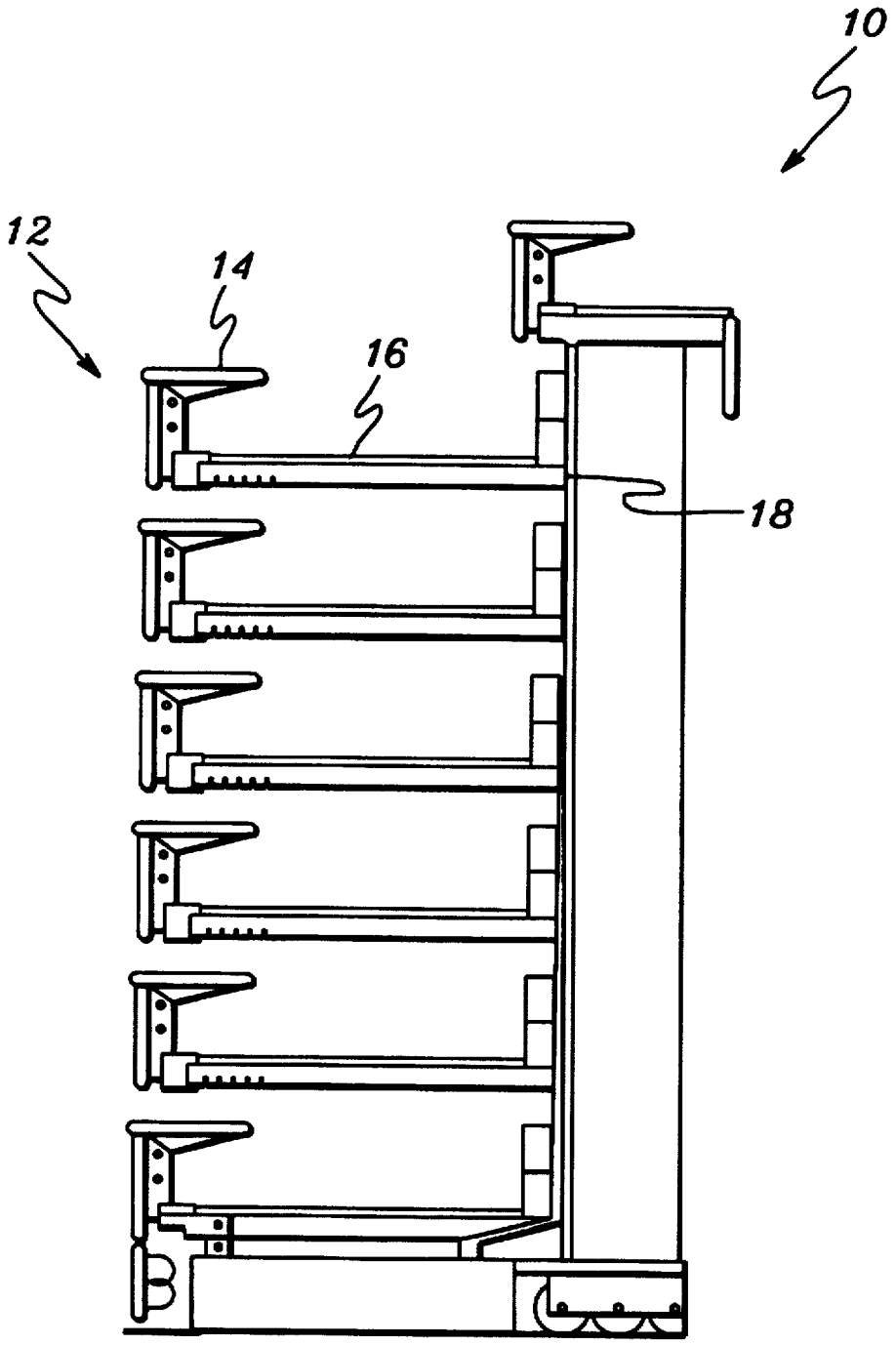
fig. 1 PRIOR ART
FIG. 1 depicts a prior art telescoping seating system.

FIG. 1 depicts a prior art telescoping seating system 10 shown in the fully retracted or closed position. System 10 comprises a plurality of foot extension members (e.g., foot extension member 12). Foot extension member 12 comprises seat member 14 and foot board 16. When system 10 is completely opened (not shown), each foot extension member is supported by a support column. However, when in the closed position as shown, the foot extension members are not supported. Thus, any downward loads placed on the foot extension members when the telescoping seating system is in the closed position causes deterioration of the connection 18 for the foot extension member.

Figure 2:
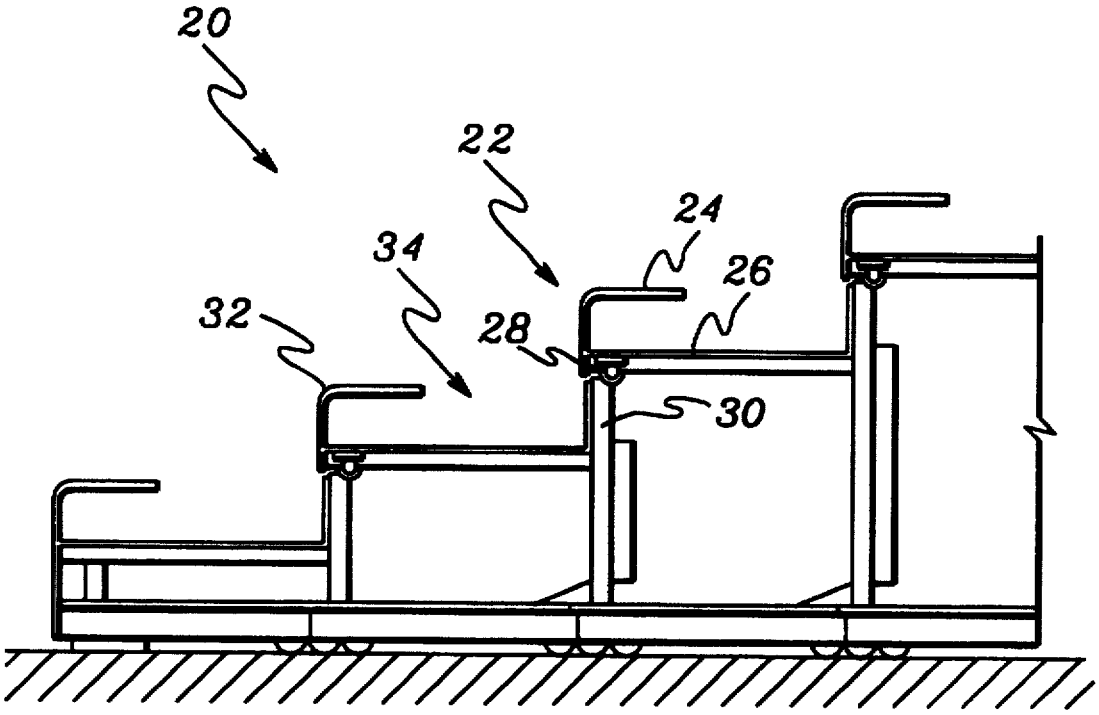
fig. 2 PRIOR ART
FIG. 2 depicts another prior art telescoping seating system.

One proposed solution to this problem is shown in FIG. 2. FIG. 2 depicts another prior art telescoping seating system 20. System 20 comprises a number of foot extension members, similar to system 10 of FIG. 1. For example, foot extension member 22 comprises seat member 24 and foot board 26. However, foot extension member 22 also includes a wheel 28 attached to a bottom surface of foot board 26. When system 20 is in the closed position (not shown), wheel 28 is intended to rest on seat 32. However, between the opened and closed positions, wheel 28 must traverse open area 34 without support. Wheel 28 could cause difficulty in obtaining the opened and closed positions, since there is not substantially continuous support therefor. Moreover, there may be no or insufficient support for wheel 28 if system 20 is only partially opened.

The present invention solves this problem by providing a surface for substantially continuous support of the wheel between the opened and closed positions.

In the recent past, based on standards adopted by the National Fire Protection Association for folding and telescoping seating, insurance companies have begun to require that entry and exit aisles be provided at predetermined intervals. This requirement has resulted in the need to retrofit existing telescoping seating systems to provide the required aisles. The most common way to effect this retrofitting has been to effectively extend the seat member to create an artificial aisle. The present invention takes advantage of such retrofitting by recognizing that it provides a support surface that was absent in the telescoping seating system of FIG. 2.

Figure 3:
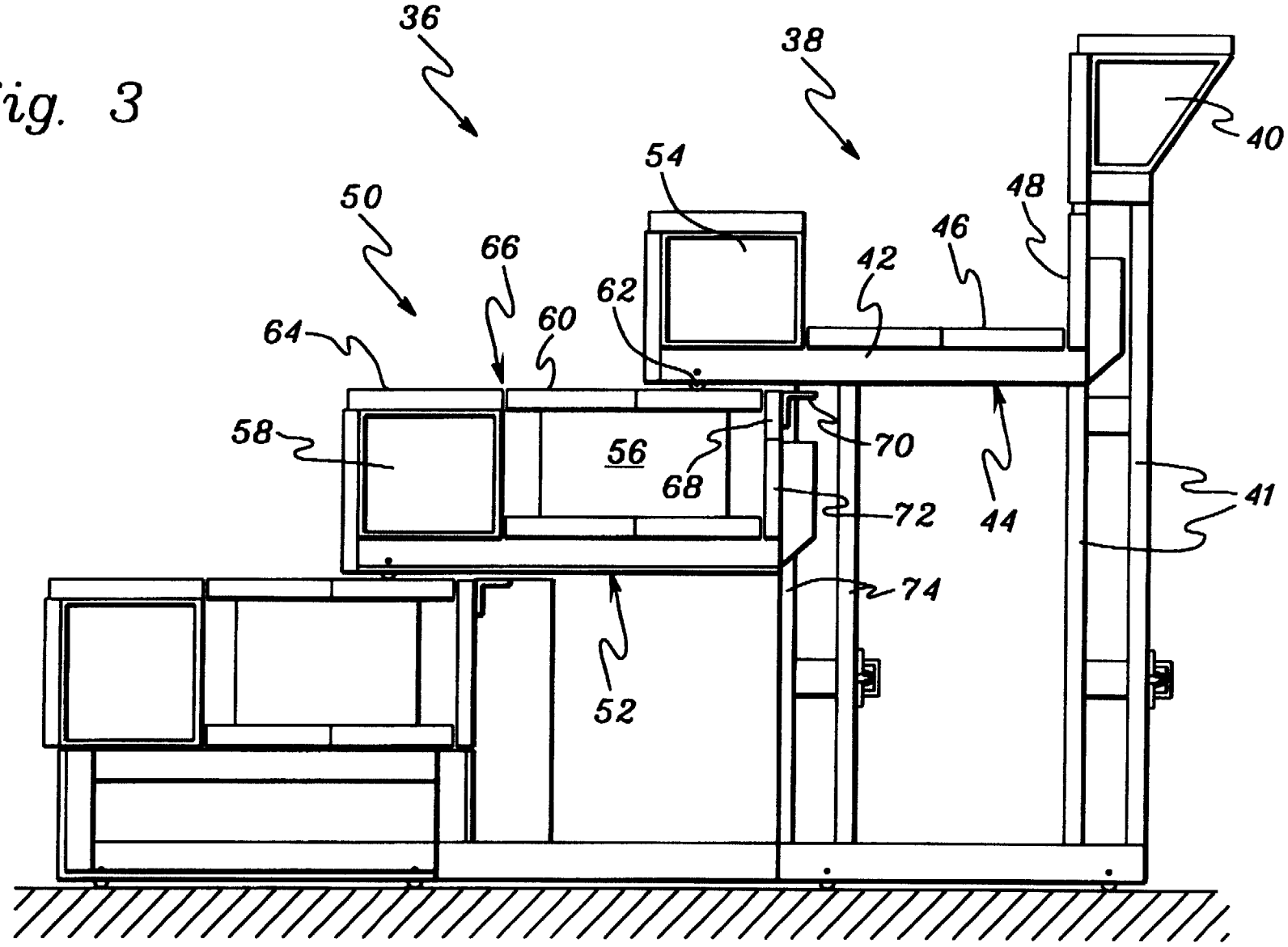
FIG. 3 depicts a telescoping seating system according to the present invention in a partially opened position.

FIG. 3 depicts a partially opened telescoping seating system 36 in accordance with the present invention. As used herein, the term "telescoping seating system" refers to seating systems that can be retracted when not in use, and may be mobile or fixed. An example of a telescoping seating system is gymnasium bleachers. System 36 comprises a plurality of seating levels, for example, seating level 38. Seating level 38 comprises seat member 40 and foot extension member 42. Seat member 40 is affixed to a rear wall (not shown). However, it will be understood that the present invention is also useful for fully mobile telescoping seating systems. As used herein, the term "seat member" refers to that portion of a seating level that provides a seat. In all seating levels other than the highest seating level, the seat member is coupled to the foot extension member of the next higher seating level. Foot extension member 42 is supported by fixed support column 41 and comprises foot board support 44, foot board 46 (the surface that a person's feet would actually rest on) and heel board or heel member 48. If one were sitting at a given seating level, for example, seating level 38, and were to move their feet backwards, the heels would intercept heel member 48. As used herein, the term "foot extension member" refers to the combination of foot board support, foot board and heel member. However, it will be understood that a foot extension member may be an integrated unit, or may comprise less or more members in actual practice.

Seating level 50, like seating level 38, comprises foot extension member 52 and seat member 54. Foot extension member 52 is supported by mobile support column 74, just as with support column 41 of seating level 38. However, coupled to foot extension member 52, is stair member 56. As used herein, the term "stair member" refers to a member placed on top of (and may or may not be coupled to) a foot board, or otherwise integrated with a foot extension member, such that the member and seat coupled to the associated foot extension member becomes a stair. In this case, stair member 56 and seat 58 together act as a stair.

Resting on an upper surface 60 of stair member 56 is wheel 62. As used herein, the term "wheel" refers to any mechanical device that allows the thing it is coupled to (here, foot extension member 44) to move relative to another surface (here, upper surface 60). As shown in FIG. 3, upper surface 60 of stair member 56 is substantially coplanar with upper surface 64 of seat member 58. A small separation 66 is shown between seat member 58 and stair member 56. Typically, separation 66 is in the range of about one-quarter to one-half of an inch wide. Preferably, separation 66 is minimized or not present, however, the retrofitting of existing telescoping seating systems generally leaves such a separation. As used herein, the term "substantially coplanar" refers to surfaces that are coplanar enough such that a given wheel could be supported from one to the other without significant difficulty. As a practical matter, this means that wheel 62 would not get stuck in separation 66, which in this case requires that the diameter of wheel 62 be greater than that of separation 66. For some systems, placement of wheel 62 along foot extension member 44 may require that additional support members, such as heel member extension 68 and angle bracket 70, be added to provide substantially continuous support for wheel 62 between the closed and opened positions. As used herein, the term "substantially continuous" refers to continuity with or without insignificant breaks. In this case, as long as the break between surfaces does not cause the wheel to get stuck, the wheel is properly supported. Heel member extension 68 is coupled to heel member 72 to extend its height to be substantially coplanar with seat member 58. Angle bracket 70 is another support member that is coupled to heel member extension 68 to further extend the substantially continuous support for wheel 62.

As used herein, the term "support member" refers to a member coupled to a foot extension member and which has an upper surface that is substantially coplanar with the upper surface of the seat member coupled thereto, and which also provides at least a portion of substantially continuous support for a wheel to traverse between the opened and closed positions of the telescoping seating system. As used herein, the term "closed position" refers to a state of the telescoping seating system when it is completely contracted. As used herein, the term "opened position" refers to a completely protracted state of the telescoping seating system such that all possible seating levels are exposed. As used herein, the term "angle bracket" refers to any nonlinear member, such as, for example, an L-shaped member. Also, as used herein, the term "couple" refers to one member being directly connected to another, or being connected through one or more intermediary members.

Figure 4:
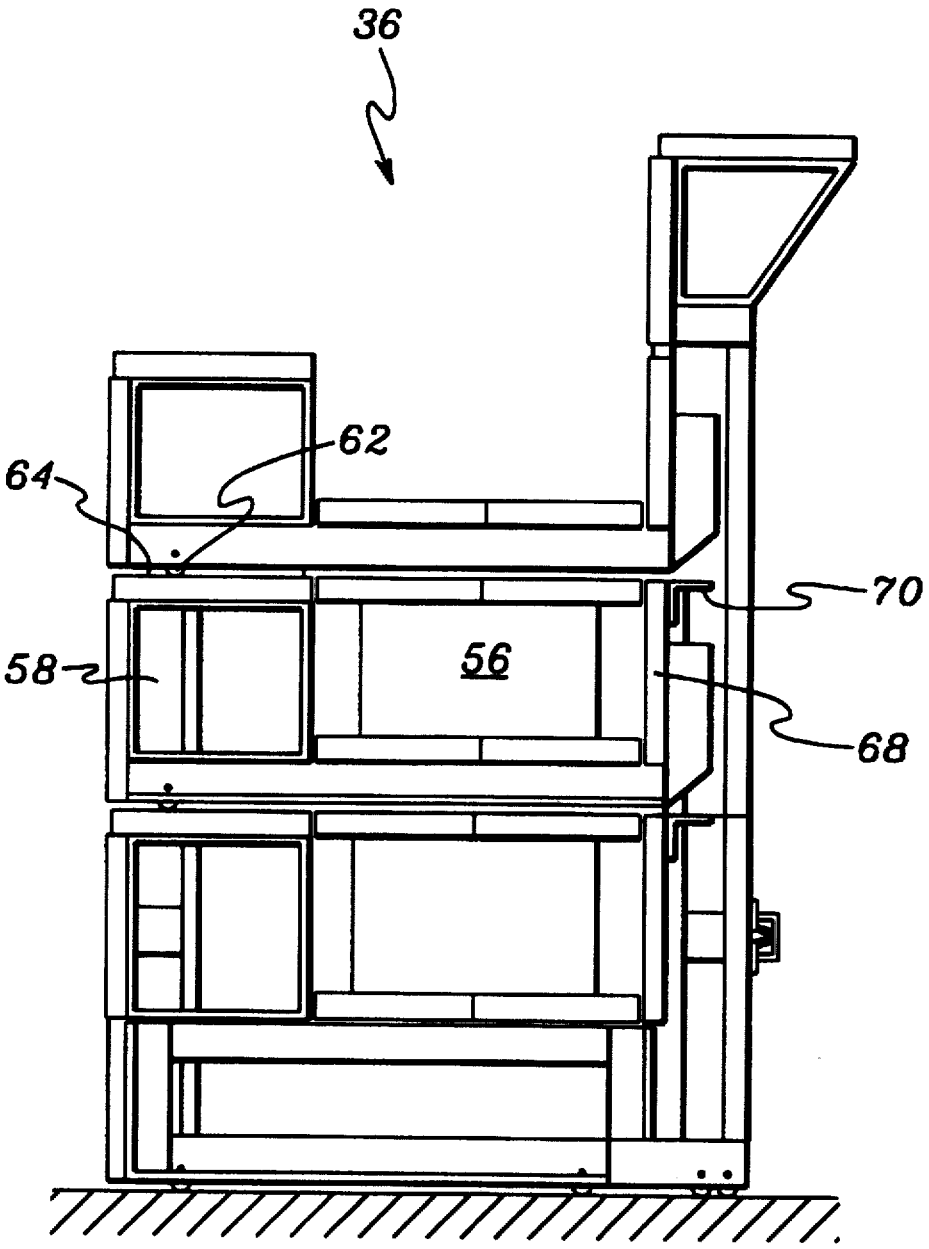
FIG. 4 depicts the telescoping seating system of FIG. 3 in the closed position.

FIG. 4 depicts the telescoping seating system 36 of FIG. 3 in a closed position. In the closed position, wheel 62 rests on upper surface 64 of seat member 58. Wheels on other seating levels experience the same type of support, thereby preventing the situation described with respect to FIG. 1. In addition, because of the substantially continuous support provided by seat member 58 in conjunction with stair member 56 and the other support members (heel member extension 68 and angle bracket 70), wheel 62 is sufficiently supported throughout the opening and closing of telescoping seating system 36.

Figure 5:
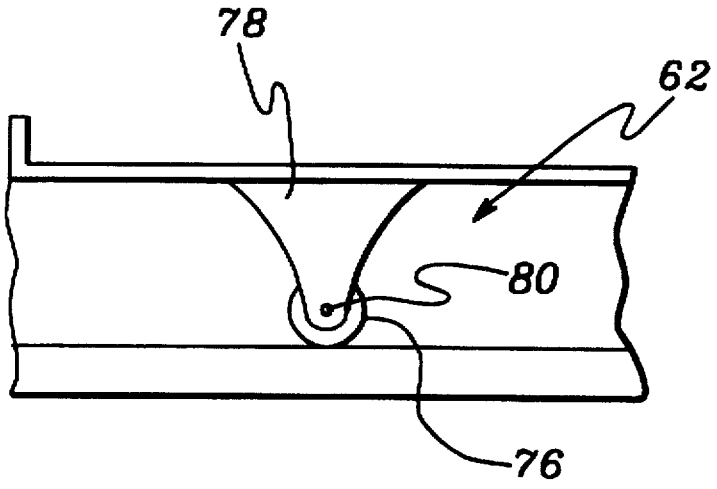
FIG. 5 depicts a wheel from the telescoping seating system of FIG. 3.

FIG. 5 is a close-up view of wheel 62. Wheel 62 comprises wheel portion 76, bracket 78, and axle 80 connecting the two. It will be understood that wheels other than that shown in FIG. 5 could be used.

Figure 6:
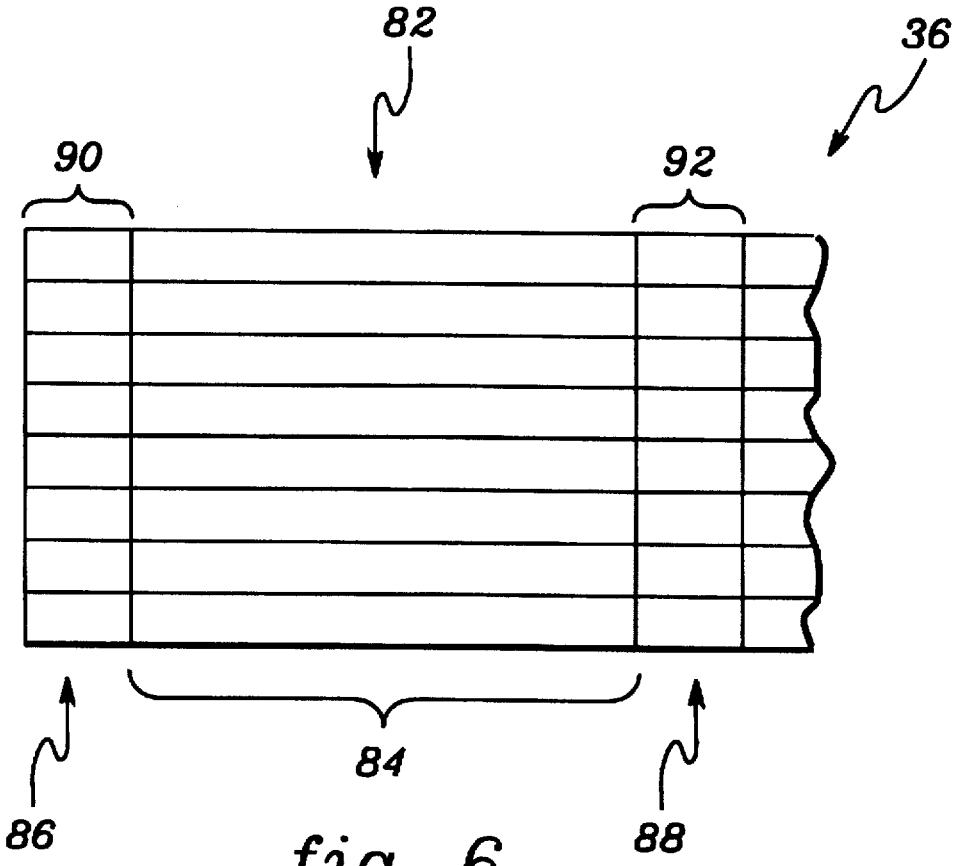
FIG. 6 is a top view of the telescoping seating system of FIG. 3 in the fully opened position.

FIG. 6 depicts a top view of the telescoping seating system 36 of FIG. 3 in the opened position. As previously noted, insurance companies have begun requiring aisles to be placed in existing telescoping seating systems at predetermined intervals. However, for new telescoping seating systems, the National Fire Protection Association standards require integrated aisles, but not necessarily seat-level aisles as described herein. Currently, the requirements result in an aisle placed every 27 feet across a seating system. As shown in FIG. 6, seating area 82 spans a distance 84, with aisles 86 and 88 on either side thereof spanning distances 90 and 92, respectively. According to the present requirements, distance 84 would be 27 feet, with distance 90 being 2 feet and distance 92 being 4 feet. The present requirements result in 2 feet of aisle for every 13 feet 6 inches of seating. However, it will be understood that these requirements may change over time. As used herein, the term "aisle" refers to cooperating stairs in a telescoping seating system allowing a person to travel from one seating level to another. Also, as used herein, the term "predetermined intervals" refers to a predetermined frequency of aisles across the width of a telescoping seating system.

While several aspects of the present invention have been described and depicted herein, alternative aspects may be effected by those skilled in the art to accomplish the same objectives. For example, it will be understood that the present invention is applicable not only to telescoping seating systems that are retrofitted to include aisles, but also those built with integrated aisles. Accordingly, it is intended by the appended claims to cover all such alternative aspects as fall within the true spirit and scope of the invention.

I claim:

1. A support structure for a telescoping seating system including a plurality of seating levels, each seating level above a lowest seating level including a seat member and a foot extension member, each seat member below a highest seat member being coupled to the foot extension member of a next higher seating level, the support structure comprising:

one or more support members coupled to or integral with the foot extension member of a first seating level, an upper surface of each of the one or more support members being substantially coplanar with an upper surface of the seat member of a second seating level directly below the first seating level; and a wheel coupled to the foot extension member of a third seating level directly above the first seating level, wherein the upper surface of the seat member of the second seating level and the upper surface of each of the one or more support members together substantiallycontinuously support the wheel between a closed position and an opened position of the telescoping seating system.

2. The support structure of claim 1, wherein the one or more support members comprises a stair member.

3. The support structure of claim 2, wherein each seating level above the lowest seating level includes a stair member and wheel such that an aisle is formed in the telescoping seating system when in the opened position.

4. The support structure of claim 3, wherein the telescoping seating system comprises a plurality of aisles spaced at predetermined intervals.

5. The support structure of claim 1, wherein the foot extension member of the first seating level comprises a heel member having a height less than that of the seat member of the second seating level, and wherein the one or more support members comprises a heel member extension coupled to the heel member.

6. The support structure of claim 1, wherein the foot extension member of the first seating level comprises a heel member, and wherein the one or more support members comprises an angle bracket coupled to the heel member.

7. A telescoping seating system, comprising:

a plurality of seating levels, each seating level above a lowest seating level including a seat member and a foot extension member, each seat member below a highest seating member being coupled to the foot extension member of a next higher seating level;

at least one support member coupled to or integral with the foot extension member of a first seating level, an upper surface of the at least one support member being substantially coplanar with an upper surface of the seat member of a second seating level directly below the first seating level; and a wheel coupled to the foot extension member of a third seating level directly above the first seating level, wherein the upper surface of the seat member of the second seating level and the upper surface of the at least one support member together substantially continuously support the wheel between a closed position and an opened position of the telescoping seating system.

8. The telescoping seating system of claim 7, wherein the at least one support member comprises a stair member.

9. The telescoping seating system of claim 8, wherein each seating level above the lowest seating level includes a stair member and wheel such that an aisle is formed in the telescoping seating system when in the opened position.

10. The telescoping seating system of claim 9 further comprising a plurality of aisles spaced at predetermined intervals.

11. The telescoping seating system of claim 7, wherein the foot extension member of the first seating level comprises a heel member having a height less than that of the seat member of the second seating level, and wherein the at least one support member comprises a heel member extension coupled to the heel member.

12. The telescoping seating system of claim 7, wherein the foot extension member of the first seating level comprises a heel member, and wherein the at least one support member comprises an angle bracket coupled to the heel member.

* * * * *

UNITED STATES PATENT AND TRADEMARK OFFICE

CERTIFICATE OF CORRECTION

PATENT NO. : 5,784,835

DATED : Jul. 28, 1998

INVENTOR(S) : Louis Robert McArthur, Jr.

It is certified that error appears in the above-identified patent and that said Letters Patent is hereby corrected as shown below:

Claim 1, Column 5, Line 15:

Delete "lycontinuously" and insert --ly continuously--.

Signed and Sealed this

Ninth Day of February, 1999

*Attest:*

*Acting Commissioner of Patents and Trademarks*

*Attesting Officer*